US009157684B2

(12) United States Patent
Komori et al.

(10) Patent No.: US 9,157,684 B2
(45) Date of Patent: Oct. 13, 2015

(54) REFRIGERATION APPARATUS

(75) Inventors: Kou Komori, Nara (JP); Tomoichiro Tamura, Osaka (JP); Bunki Kawano, Osaka (JP); Hidetoshi Taguchi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 197 days.

(21) Appl. No.: 14/114,403

(22) PCT Filed: Apr. 27, 2012

(86) PCT No.: PCT/JP2012/002932

§ 371 (c)(1),
(2), (4) Date: Oct. 28, 2013

(87) PCT Pub. No.: WO2012/147366

PCT Pub. Date: Nov. 1, 2012

(65) Prior Publication Data

US 2014/0053596 A1 Feb. 27, 2014

(30) Foreign Application Priority Data

Apr. 28, 2011 (JP) ..... 2011-101223

(51) Int. Cl.
*F28B 1/00* (2006.01)
*F25B 1/10* (2006.01)
*F25B 41/04* (2006.01)

(52) U.S. Cl.
CPC ... *F28B 1/00* (2013.01); *F25B 1/10* (2013.01); *F25B 41/04* (2013.01); *F25B 2400/13* (2013.01)

(58) Field of Classification Search
CPC ..... F25B 41/00; F25B 41/04; F25B 41/046; F25B 39/02; F25B 31/006; F25B 31/008; F25B 31/02; F25B 31/023; F25B 31/026; F25B 9/008; F24F 5/001
See application file for complete search history.

(56) References Cited

U.S. PATENT DOCUMENTS 5,067,330 A * 11/1991 Cook et al. ..... 62/485
7,451,616 B2 11/2008 Ro (Continued)

FOREIGN PATENT DOCUMENTS

CN 101583832 11/2009
CN 201672748 U 12/2010

(Continued)

OTHER PUBLICATIONS

Search Report for corresponding Chinese Patent Application No. 201280019893.3 with an English Translation—5 pages.

*Primary Examiner* — Frantz Jules
*Assistant Examiner* — Erik Mendoza-Wilkenfel
(74) *Attorney, Agent, or Firm* — Hamre, Schumann, Mueller & Larson, P.C.

(57) ABSTRACT

A refrigeration apparatus (air conditioner (1A)) includes: a vapor channel (2A) that directs a refrigerant vapor from an evaporator (25) to a condenser (23); a liquid channel (2B) that directs a refrigerant liquid from the condenser (23) to the evaporator (25); a first circulation path (4) that allows the refrigerant liquid retained in the evaporator (25) to circulate via a first heat exchanger (indoor heat exchanger (31)); and a second circulation path (5) that allows the refrigerant liquid retained in the condenser (23) to circulate via a second heat exchanger (outdoor heat exchanger (33)). A first switching means and a second switching means are provided on the first circulation path (4) and the second circulation path (5). The first switching means and the second switching means are, for example, four-way valves 61 and 62.

5 Claims, 3 Drawing Sheets

(56) References Cited

U.S. PATENT DOCUMENTS

| | | | | |
|---|---|---|---|---|
| 2009/0095001 | A1* | 4/2009 | Imai et al. | 62/196.3 |
| 2012/0174610 | A1* | 7/2012 | Takayama et al. | 62/196.1 |

FOREIGN PATENT DOCUMENTS

| | | |
|---|---|---|
| JP | 2-208459 | 8/1990 |
| JP | 3-144266 | 6/1991 |
| JP | 8-014608 | 1/1996 |
| JP | 2006-038333 | 2/2006 |
| JP | 2006-097989 | 4/2006 |
| JP | 2006-194579 | 7/2006 |
| JP | 2008-122012 | 5/2008 |
| JP | 2008-275288 | 11/2008 |
| JP | 2009-058165 | 3/2009 |
| WO | 2009/121548 | 10/2009 |

* cited by examiner

REFRIGERATION APPARATUS

TECHNICAL FIELD

The present invention relates to a refrigeration apparatus.

BACKGROUND ART

Conventionally, refrigeration apparatuses such as air conditioners, in which chlorofluorocarbon or an alternative for chlorofluorocarbon is used as a refrigerant, are widely used. However, when such refrigerants are released into the atmosphere, they cause direct ozone depletion and have high global warming potentials. In view of these, air conditioners have been proposed in which a natural refrigerant such as water, carbon dioxide, or hydrocarbon is used as a refrigerant having a very low impact on the global environment. For example, Patent Literature 1 discloses an air conditioner 100 as shown in FIG. 3, in which water is used as a refrigerant.

When water is used as a refrigerant for an air conditioner, the refrigerant in a low pressure and low density state flows in the system due to the physical properties of water. Therefore, the volumetric flow rate of the refrigerant to be compressed and the pressure ratio in a compressor need to be significantly increased. In the air conditioner 100 disclosed in Patent Literature 1, a Roots-type positive displacement compressor 110 is used as the compressor. Cooling operation and heating operation can be switched by switching the rotational direction of the Roots-type rotary compression means between the forward direction and the reverse direction.

Specifically, the air conditioner 100 includes a first casing 101 and a second casing 102 that retain water. The air conditioner 100 further includes an indoor-side circulation path 120 that allows the water in the first casing 101 to circulate via an indoor heat exchanger 121 and an outdoor-side circulation path 130 that allows the water in the second casing 102 to circulate via an outdoor heat exchanger 131. The upper part of the first casing 101 and the upper part of the second casing 102 are connected by a first communication path 103, and a compressor 110 is provided on this first communication path 103. The lower part of the first casing 101 and the lower part of the second casing 102 are connected by a second communication path 104.

In the cooling operation, the compressor 110 rotates in the forward direction so as to allow water vapor to flow in a direction indicated by solid arrows, and the first casing 101 functions as an evaporator and the second casing 102 functions as a condenser. Cold water is produced in the first casing 101, and this cold water is supplied to the indoor heat exchanger 121. Thus, the cooling operation is performed. On the other hand, in the heating operation, the compressor 110 rotates in the reverse direction so as to allow water vapor to flow in a direction indicated by dashed arrows, and the second casing 102 functions as an evaporator and the first casing 101 functions as a condenser. Hot water is produced in the first casing 101, and this hot water is supplied to the indoor heat exchanger 121. Thus, the heating operation is performed.

CITATION LIST

Patent Literature

Patent Literature 1: JP 2009-058165 A

SUMMARY OF INVENTION

Technical Problem

However, the use of the Roots-type compressor 110 as in the air conditioner 100 disclosed in Patent Literature 1 has various drawbacks. For example, one of the drawbacks is that the size of the Roots-type compressor itself needs to be increased to achieve a high volumetric flow rate using the Roots-type compressor.

With the objectives of overcoming the drawbacks of the Roots-type compressor 110 and achieving high efficiency using a compressor, it may be possible to use a centrifugal compressor. However, if a centrifugal compressor is used in the air conditioner 100 of Patent Literature 1, only one of cooling operation and heating operation can be performed.

In view of the above problems, it is an object of the present invention to provide a refrigeration apparatus such as an air conditioner capable of switching between cooling and heating, regardless of the type of a compressor used.

Solution to Problem

In order to achieve the above object, a first aspect of the present disclosure provides a refrigeration apparatus including: an evaporator that retains a refrigerant liquid and that evaporates the refrigerant liquid therein; a condenser that condenses a refrigerant vapor therein and that retains the refrigerant liquid; a vapor channel that directs the refrigerant vapor from the evaporator to the condenser and that is provided with a compressor; a liquid channel that directs the refrigerant liquid from the condenser to the evaporator; a first circulation path that allows the refrigerant liquid retained in the evaporator to circulate via a first heat exchanger and that is provided with a first pump at a position upstream from the first heat exchanger; a second circulation path that allows the refrigerant liquid retained in the condenser to circulate via a second heat exchanger and that is provided with a second pump at a position upstream from the second heat exchanger; a first switching means that is provided on the first circulation path and the second circulation path and that is switched between a first state and a second state, the first state being a state in which the refrigerant liquid pumped from the first pump is directed to the first heat exchanger and the refrigerant liquid pumped from the second pump is directed to the second heat exchanger, and the second state being a state in which the refrigerant liquid pumped from the first pump is directed to the second heat exchanger and the refrigerant liquid pumped from the second pump is directed to the first heat exchanger; and a second switching means that is provided on the first circulation path and the second circulation path and that is switched between a first state and a second state, the first state being a state in which the refrigerant liquid flowing from the first heat exchanger is directed to the evaporator and the refrigerant liquid flowing from the second heat exchanger is directed to the condenser, and the second state being a state in which the refrigerant liquid flowing from the first heat exchanger is directed to the condenser and the refrigerant liquid flowing from the second heat exchanger is directed to the evaporator.

Advantageous Effects of Invention

According to the first aspect of the present disclosure, it is possible to perform cooling when the first switching means is switched to the first state and the second switching means is switched to the first state, and to perform heating when the first switching means is switched to the second state and the second switching means is switched to the second state. In addition, the first switching means and the second switching means are provided on the first circulation path and the second circulation path, which are separated from the refrigerant circuit including the evaporator, the vapor channel, the condenser, and the liquid channel. Therefore, it is possible to allow the evaporator and the condenser to be dedicated to one function so as to increase their respective performance levels. It is also possible to use any type of compressor. In particular, if a centrifugal compressor is used, it is possible not only to avoid an increase in the size of the refrigeration apparatus but also to achieve an increase in the efficiency thereof.

DESCRIPTION OF EMBODIMENTS

A second aspect provides the refrigeration apparatus as set forth in the first aspect, wherein the compressor may include: a first compressor that compresses the refrigerant vapor that has flowed from the evaporator; and a second compressor that further compresses the refrigerant vapor that has been compressed by the first compressor. The vapor channel may be provided with an intercooler that cools the refrigerant vapor between the first compressor and the second compressor.

A third aspect provides the refrigeration apparatus as set forth in the second aspect, which may further include a vapor cooling channel that is branched from the second circulation path at a position downstream from the second switching means and is connected to the intercooler, the vapor cooling channel being provided with a flow rate regulating mechanism. The intercooler may be configured to cool the refrigerant vapor by mixing the refrigerant liquid supplied from the vapor cooling channel with the refrigerant vapor.

A fourth aspect provides the refrigeration apparatus as set forth in the second or the third aspect, which may further includes: a bearing cooling channel that withdraws the refrigerant vapor cooled by the intercooler from the intercooler or the vapor channel and that feeds the withdrawn refrigerant vapor to bearing portions of the first compressor and the second compressor; and a recovery channel that returns the refrigerant vapor from the bearing portions of the first compressor and the second compressor to the evaporator.

A fifth aspect provides the refrigeration apparatus as set forth in any one of the first to fourth aspects, wherein a height from a suction port of the first pump to a level of the refrigerant liquid retained in the evaporator may be 200 mm or more. A height from a suction port of the second pump to a level of the refrigerant liquid retained in the condenser may be 200 mm or more.

A Roots-type compressor has the following drawbacks. The first drawback is that there is a constraint on the upper limit of the rotational speed of the compressor itself. In particular, when a refrigerant whose main component is water or alcohol is used, a refrigerant vapor has a very low density due to its physical properties and therefore the internal volume needs to be increased to increase the volumetric flow rate. Thus, the size of the entire apparatus is increased. The second drawback is that large friction loss occurs in the Roots-type rotary compression means, which makes it difficult to increase the efficiency. The third drawback is that it is difficult to cool the compressor itself, resulting in a high discharge temperature. The fourth drawback is that oil lubrication is absolutely necessary for the compressor and the lubricating oil serves as a thermal resistance in a heat exchanger.

Hereinafter, embodiments of the present invention are described in detail based on the drawings.

Figure 1:
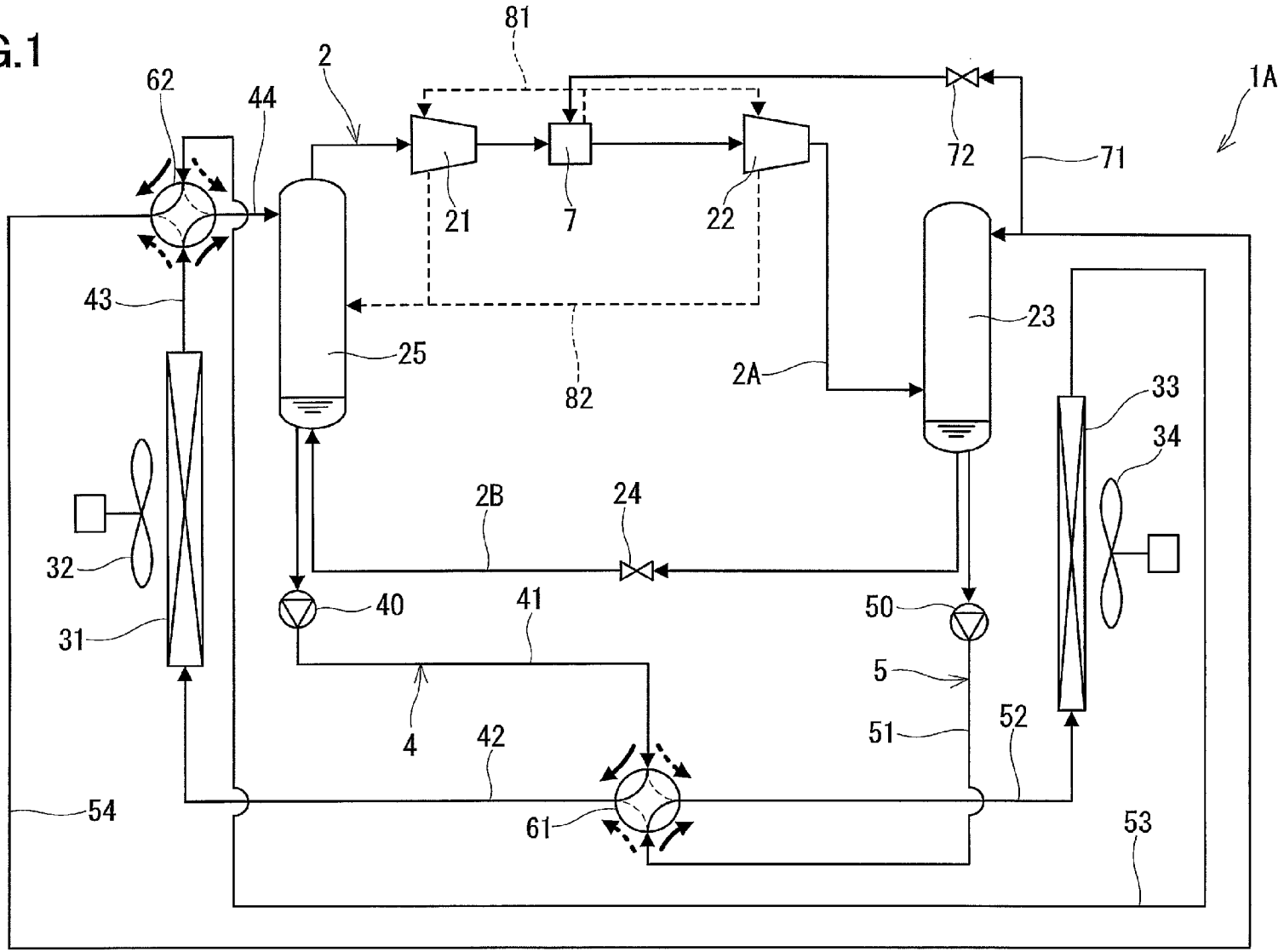
FIG. 1 is a configuration diagram of an air conditioner according to one embodiment of the present invention.

FIG. 1 shows an air conditioner 1A (refrigeration apparatus) according to one embodiment of the present invention. This air conditioner 1A includes: a refrigerant circuit 2 including an evaporator 25, a vapor channel 2A, a condenser 23, and a liquid channel 2B; a first circulation path 4, both ends of which are connected to the evaporator 25; and a second circulation path 5, both ends of which are connected to the condenser 23. The inside of each of the refrigerant circuit 2, the first circulation path 4, and the second circulation path 5 is filled with a refrigerant whose saturated vapor pressure is a negative pressure at ordinary temperature, for example, a refrigerant whose main component is water, alcohol or ether, and the pressure in each of the refrigerant circuit 2, the first circulation path 4, and the second circulation path 5 is a negative pressure lower than the atmospheric pressure. The term "main component" refers to a component whose content is the highest in mass.

The evaporator 25 retains a refrigerant liquid, and evaporates the refrigerant liquid therein. The condenser 23 condenses a refrigerant vapor therein, and retains the refrigerant liquid. The vapor channel 2A directs the refrigerant vapor from the evaporator 25 to the condenser 23. The liquid channel 2B directs the refrigerant liquid from the condenser 23 to the evaporator 25. In the present embodiment, a first compressor 21, an intercooler 7, and a second compressor 22 are provided on the vapor channel 2A, and an expansion mechanism 24 is provided on the liquid channel 2B.

The first circulation path 4 allows the refrigerant liquid retained in the evaporator 25 to circulate via an indoor heat exchanger 31 (first heat exchanger). The second circulation path 5 allows the refrigerant liquid retained in the condenser 23 to circulate via an outdoor heat exchanger 33 (second heat exchanger).

In the present embodiment, the evaporator 25 is configured in such a manner that the refrigerant liquid returning from the downstream end of the first circulation path 4 into the evaporator 25 flows down. The down-flowing refrigerant liquid is evaporated by being decompressed by the first compressor 21, vaporized, and cooled directly by the latent heat of vaporization. Strictly speaking, the point of equilibrium between the vapor and the liquid is shifted to the evaporation side, and the liquid side is cooled by the latent heat of evaporation. The refrigerant liquid returning to the evaporator 25 may be sprayed from the downstream end of the first circulation path 4. Preferably, a packing material is disposed in the evaporator 25 to form a liquid film from the down-flowing refrigerant liquid. As the packing material, for example, a regular packing material composed of layered corrugated plates may be used. Alternatively, a random packing material composed of open-ended cylindrical packing members having a hollow interior with a diameter of one half to one inch may be used in such a manner that the cylindrical packing members are randomly placed in the evaporator to occupy one-half to two-third of the internal volume of the evaporator.

The condenser 23 is configured in such a manner that the refrigerant liquid returning from the downstream end of the second circulation path 5 into the condenser 23 flows down. The superheated refrigerant vapor discharged from the second compressor 22 is condensed by direct contact with the down-flowing refrigerant liquid and liquefied, and the latent heat of liquefaction is transferred to the down-flowing refrigerant liquid. The refrigerant liquid returning into the condenser 23 may be sprayed from the downstream end of the second circulation path 5. Preferably, a packing material is disposed in the condenser 23 to form a liquid film from the down-flowing refrigerant liquid. As the packing material, for example, a regular packing material composed of layered corrugated plates may be used. Alternatively, a random packing material composed of open-ended cylindrical packing members having a hollow interior with a diameter of one half to one inch may be used in such a manner that the cylindrical packing members are randomly placed in the condenser to occupy one-half to two-third of the internal volume of the condenser.

In the vapor channel 2A, the saturated refrigerant vapor that has flowed from the evaporator 25 is drawn into the first compressor 21 and compressed therein. The superheated refrigerant vapor discharged from the first compressor 21 is cooled in the intercooler 7 and then drawn into the second compressor 22, where it is further compressed. The superheated refrigerant vapor discharged from the second compressor 22 flows into the condenser 23. Preferably, the downstream end of the vapor channel 2A is connected to the condenser 23 at a position near the level of the refrigerant liquid retained in the condenser 23 so that a counter flow is formed between the refrigerant vapor flowing into the condenser 23 and then flowing upward therein and the refrigerant liquid flowing downward from the downstream end of the second circulation path 5.

The saturation pressure in the evaporator 25 is, for example, 0.9 to 1.5 kPa. The refrigerant liquid of 5° C. to 15° C. retained in the evaporator 25 flows out of the evaporator 25 from the upstream end of the first circulation path 4, absorbs heat from the air in the indoor heat exchanger 31 or the outdoor heat exchanger 33, and changes into the refrigerant liquid having a 2° C. to 7° C. higher temperature. The refrigerant liquid having a 2° C. to 7° C. higher temperature returns into the evaporator 25, and evaporates or exchanges heat with the already existing refrigerant vapor, while flowing down from the downstream end of the first circulation path 4.

Indoor air is supplied to the indoor heat exchanger 31 by an indoor fan 32, and outdoor air is supplied to the outdoor heat exchanger 33 by an outdoor fan 34. As the indoor heat exchanger 31 and the outdoor heat exchanger 33, radiant panels utilizing radiation, cooling towers, fin and tube heat exchangers, etc., which have been conventionally used in air conditioners, can be used.

The refrigerant vapor is compressed in two stages by the first compressor 21 and the second compressor 22. The first compressor 21 and the second compressor 22 may each be a positive displacement compressor or a centrifugal compressor. The temperature of the refrigerant vapor discharged from the first compressor 21 is, for example, 110° C. to 140° C., and the temperature of the refrigerant vapor discharged from the second compressor 22 is, for example, 140° C. to 170° C.

In the present embodiment, the intercooler 7 is configured to cool the refrigerant vapor by mixing the refrigerant liquid supplied from a vapor cooling channel 71 described later with the refrigerant vapor. Preferably, the refrigerant liquid supplied to the intercooler 7 is sprayed in the intercooler 7 and flows down. In the intercooler 7, the superheated refrigerant vapor discharged from the first compressor 21 is cooled almost to a saturated vapor temperature corresponding to the discharge pressure of the first compressor 21 or the suction pressure of the second compressor 22 by the latent heat of vaporization of a portion of the refrigerant liquid supplied from the vapor cooling channel 71. The same or similar packing material (a regular packing material or a random packing material) as that disposed in the evaporator 25 and the condenser 23 as described above may be disposed in the intercooler 7.

The intercooler 7 is not limited to the above-described configuration, and it may be configured in any manner as long as it is capable of cooling the refrigerant vapor. For example, the intercooler 7 may be a heat exchanger for releasing the heat of the refrigerant vapor to the air or the refrigerant liquid.

In the condenser 23, the superheated refrigerant vapor of 140° C. to 170° C. discharged from the second compressor 22 is cooled by heat exchange with the refrigerant liquid of 30° C. to 50° C. flowing down from the downstream end of the second circulation path 5, and thus condensed. The down-flowing refrigerant liquid of 30° C. to 50° C. receives heat from the superheated refrigerant vapor and thus changes into the refrigerant liquid having a 2° C. to 7° C. higher temperature. Then, the refrigerant liquid flows out of the condenser 23 from the upstream end of the second circulation path 5, and releases heat to the air in the outdoor heat exchanger 33 or the indoor heat exchanger 31.

In the liquid channel 2B connecting the condenser 23 and the evaporator 25 via the expansion mechanism 24, the refrigerant liquid is caused to flow from the condenser 23 to the evaporator 25 by the suction of the refrigerant vapor from the evaporator 25 into the first compressor 21 and the discharge of the refrigerant vapor from the second compressor 22 into the condenser 23. In the course of this flow, the refrigerant liquid is expanded by the expansion mechanism 24.

As the expansion mechanism 24, a small diameter tube capable of keeping the flow rate of the refrigerant liquid, which flows from the operating environment at a pressure of 9 to 12 kPa in the condenser 23, within 1 to 5 L/min may be used. The expansion mechanism 24, however, need not necessarily be provided. For example, without the expansion mechanism 24, control may be performed so that the level of the refrigerant liquid in the evaporator 25 becomes higher than the level of the refrigerant liquid in the condenser 23.

When a refrigerant containing water as a main component and further containing ethylene glycol, Nybrine, an inorganic salt, or the like in an amount of 10 to 40% by mass is used as the refrigerant for the reasons such as prevention of freezing, etc., only the water in the form of the refrigerant vapor is drawn from the evaporator 25 into the first compressor 21, and thus the refrigerant liquid retained in the evaporator 25 is concentrated. On the other hand, the dilution of the refrigerant liquid retained in the condenser 23 proceeds as the operating time increases. In order to reduce the difference between the concentration of the refrigerant liquid retained in the evaporator 25 and that of the refrigerant liquid retained in the condenser 23, it is possible to connect the upstream end of the liquid channel 2B to a water intake provided at a position lower by 20 to 50 mm than the level of the refrigerant liquid retained in the condenser 23 so as to return the low-concentration refrigerant liquid to the evaporator 25 through the liquid channel 2B, and thus to suppress the increase in the concentration of the refrigerant liquid retained in the evaporator 25.

Alternatively, another method may be employed to dilute the concentrated refrigerant liquid in the evaporator 25. When the operation is stopped, a first four-way valve 61 and a second four-way valve 62 described later are controlled so that the refrigerant liquid in the condenser 23 is pumped into the evaporator 25 via the first four-way valve 61, the outdoor heat exchanger 33, and the second four-way valve 62 by a second pump 50, so as to reduce the concentration difference between the evaporator 25 and the condenser 23.

The first circulation path 4 that allows the refrigerant liquid retained in the evaporator 25 to circulate is provided with the first pump 40 at a position upstream from the indoor heat exchanger 31. The second circulation path 5 that allows the refrigerant liquid retained in the condenser 23 to circulate is provided with the second pump 50 at a position upstream from the outdoor heat exchanger 33. From the viewpoint of suppressing cavitation, it is preferable that the height H1 from the suction port of the first pump 40 to the level of the refrigerant liquid in the evaporator 25 be 200 mm or more and that the height H2 from the suction port of the second pump 50 to the level of the refrigerant liquid in the condenser 23 also be 200 mm or more. Since both the inside of the evaporator 25 and the inside of the condenser 23 are in the saturated state, the heights H1 and H2 are equal to the available net positive suction head (available NPSH).

A section between the first pump 40 and the indoor heat exchanger 31 in the first circulation path 4 and a section between the second pump 50 and the outdoor heat exchanger 33 in the second circulation path 5 intersect each other, and the first four-way valve 61 is provided at that intersection. Furthermore, a section between the indoor heat exchanger 31 and the evaporator 25 in the first circulation path 4 and a section between the outdoor heat exchanger 33 and the condenser 23 in the second circulation path 5 intersect each other, and the second four-way valve 62 is provided at that intersection.

More specifically, the first circulation path 4 includes: a first flow path 41 connecting the evaporator 25 and the first four-way valve 61 and provided with the first pump 40; a second flow path 42 connecting the first four-way valve 61 and the indoor heat exchanger 31; a third flow path 43 connecting the indoor heat exchanger 31 and the second four-way valve 62; and a fourth flow path 44 connecting the second four-way valve 62 and the evaporator 25. Likewise, the second circulation path 5 includes: a first flow path 51 connecting the condenser 23 and the first four-way valve 61 and provided with the second pump 50; a second flow path 52 connecting the first four-way valve 61 and the outdoor heat exchanger 33; a third flow path 53 connecting the outdoor heat exchanger 33 and the second four-way valve 62; and a fourth flow path 54 connecting the second four-way valve 62 and the condenser 23.

The first four-way valve 61 corresponds to the first switching means of the present invention, and is switched between a first state in which the refrigerant liquid is caused to flow in a direction indicated by solid arrows and a second state in which the refrigerant liquid is caused to flow in a direction indicated by dashed arrows. In the first state, the first four-way valve 61 directs the refrigerant liquid pumped from the first pump 40 to the indoor heat exchanger 31 and directs the refrigerant liquid pumped from the second pump 50 to the outdoor heat exchanger 33. In the second state, the first four-way valve 61 directs the refrigerant liquid pumped from the first pump 40 to the outdoor heat exchanger 33 and directs the refrigerant liquid pumped from the second pump 50 to the indoor heat exchanger 31.

The second four-way valve 62 corresponds to the second switching means of the present invention, and is switched between a first state in which the refrigerant liquid is caused to flow in a direction indicated by solid arrows and a second state in which the refrigerant liquid is caused to flow in a direction indicated by dashed arrows. In the first state, the second four-way valve 62 directs the refrigerant liquid flowing from the indoor heat exchanger 31 to the evaporator 25 and directs the refrigerant liquid flowing from the outdoor heat exchanger 33 to the condenser 23. In the second state, the second four-way valve 62 directs the refrigerant liquid flowing from the indoor heat exchanger 31 to the condenser 23 and directs the refrigerant liquid flowing from the outdoor heat exchanger 33 to the evaporator 25.

The vapor cooling channel 71 for supplying the refrigerant liquid to the above-mentioned intercooler 7, in other words, for injecting the refrigerant liquid to the intercooler 7, is branched from the fourth flow path 54 between the second four-way valve 62 and the condenser 23 in the second circulation path 5 and is connected to the intercooler 7. The vapor cooling channel 71 is provided with a flow rate regulating mechanism 72. The flow rate regulating mechanism 72 may be provided in the intercooler 7.

As the flow rate regulating mechanism 72, for example, a small diameter tube, like the above-mentioned expansion mechanism 24, capable of keeping the flow rate of the refrigerant liquid within 1 to 5 L/min between an operating environment at a pressure of 9 to 12 kPa in the condenser 23 and an operating environment at a pressure of 3 to 4 kPa in the intercooler 7. Alternatively, it is also possible to use a relief valve for opening the flow path by the movement of a valve body against a biasing force of a spring or a plunger. The biasing force is determined to achieve the desired flow rate.

Furthermore, in the present embodiment, a configuration for air-tightly sealing and cooling the bearing portions of the first compressor 21 and the second compressor 22 is employed. Specifically, a bearing cooling channel 81 and a recovery channel 82 are provided. The bearing cooling channel 81 withdraws the refrigerant vapor cooled by the intercooler 7 from the intercooler 7 and feeds the withdrawn refrigerant vapor to the bearing portions of the first compressor 21 and the second compressor 22. The recovery channel 82 returns the refrigerant vapor from the bearing portions of the first compressor 21 and the second compressor 22 to the evaporator 25. The bearing cooling channel 81 may be configured to withdraw the refrigerant vapor cooled by the intercooler 7 from the vapor channel 2A.

The bearing cooling channel 81 is configured in such a manner that one main pipe is divided into a plurality of branch pipes. The upstream end of the bearing cooling channel 81 opens into a vapor layer region in the intercooler 7. A small amount of the refrigerant vapor is withdrawn from the intercooler 7 through the bearing cooling channel 81 and fed to the bearing portions of the first compressor 21 and the second compressor 22. The recovery channel 82 is configured in such a manner that a plurality of branch pipes are merged into one main pipe. The refrigerant vapor that has cooled the bearing portions is discharged from the bearing portion at a position displaced at a phase angle of 90° to 180° about the outer periphery of the bearing portion and returned to the evaporator 25 through the recovery channel 82. The pressure in the intercooler 7 and the pressure in the evaporator 25 are 3 to 4 kPa and 0.9 to 1.5 kPa, respectively, and the pressure difference between them allows the refrigerant vapor to flow reliably.

In order to cool the motor stator portions of the first compressor 21 and the second compressor 22 that have generated heat, the refrigerant liquid withdrawn from the fourth flow path 54 of the second circulation path 5 through the vapor cooling channel 71 is fed into the cooling channel around the outer periphery of each of the motor stator portions to cool them and then returned to the liquid retaining layer on the bottom of the condenser 23 or a section upstream from the second pump 50 in the first flow path 51 of the second circuit path 5. Thus, the use of the refrigerant liquid on the condenser 23 side makes it possible to avoid boiling of the refrigerant liquid whose temperature is raised when it cools the motor stator portions.

Next, how the air conditioner 1A works in cooling operation and heating operation is described.

In the cooling operation, the first four-way valve 61 is switched to the first state, and the second four-way valve 62 is switched to the first state. The refrigerant liquid in the evaporator 25 is pumped from the first pump 40 into the indoor heat exchanger 31 through the first four-way valve 61 and the second flow path 42. In the indoor heat exchanger 31, the refrigerant liquid absorbs heat from the indoor air and then returns to the evaporator 25 through the third flow path 43, the second four-way valve 62, and the fourth flow path 44. On the other hand, the refrigerant liquid in the condenser 23 is pumped from the second pump 50 into the outdoor heat exchanger 33 through the first four-way valve 61 and the second flow path 52. In the outdoor heat exchanger 33, the refrigerant liquid releases heat to the outdoor air and then returns to the condenser 23 through the third flow path 53, the second four-way valve 62, and the fourth flow path 54.

In the heating operation, the first four-way valve 61 is switched to the second state, and the second four-way valve 62 is switched to the second state. The refrigerant liquid in the evaporator 25 is pumped from the first pump 40 into the outdoor heat exchanger 33 through the first four-way valve 61 and the second flow path 52. In the outdoor heat exchanger 33, the refrigerant liquid absorbs heat from the outdoor air and then returns to the evaporator 25 through the third flow path 53, the second four-way valve 62, and the fourth flow path 44. On the other hand, the refrigerant liquid in the condenser 23 is pumped from the second pump 50 into the indoor heat exchanger 31 through the first four-way valve 61 and the second flow path 42. In the indoor heat exchanger 31, the refrigerant liquid releases heat to the indoor air and then returns to the condenser 23 through the third flow path 43, the second four-way valve 62, and the fourth flow path 54.

During the start-up operation, the indoor fan 32 and the outdoor fan 34 are first started, then the expansion mechanism 24 is fully opened, and the first four-way valve 61 is switched to the first state and the second four-way valve 62 is switched to the first state. Furthermore, the first pump 40 is started, and the rotational speed of the first pump 40 is increased to a predetermined value so as to cause the refrigerant liquid in the evaporator 25 to boil by absorption of heat from the indoor air in the indoor heat exchanger 31. Next, the second pump 50 is started, and the rotational speed of the second pump 50 is increased to a predetermined value so as to form a wetted surface of the refrigerant liquid on a film formation member when the film formation member is disposed in the condenser 23. Then, the flow rate regulating mechanism 72 provided on the vapor cooling channel 71 is fully opened to start injection into the intercooler 7, and a wetted surface is formed on a film formation member when the film formation member is disposed in the intercooler 7. Finally, the first compressor 21 and the second compressor 22 are started, and the rotational speed of each of the first compressor 21 and the second compressor 22 is increased until the temperature of the refrigerant vapor discharged from the second compressor 22 reaches a predetermined temperature. When the temperature of the refrigerant liquid in the evaporator 25 drops too low, the rotational speed of the first pump 40 is increased or the rotational speeds of the first compressor 21 and the second compressor 22 are decreased so as to adjust the temperature of the refrigerant liquid in the evaporator 25.

In the air conditioner 1A of the present embodiment described above, the refrigerant circuit 2 consisting of two paths, the vapor channel 2A and the liquid channel 2B, is employed, and the first four-way valve 61 and the second four-way valve 62 are provided on the refrigerant liquid circulation route. Thereby, the operation can be switched between cooling and heating, and any type of compressor can be used.

In addition, the bearing portions of the first compressor 21 and the second compressor 22 are externally cooled while being kept airtight by the refrigerant vapor. Thereby, a bearing that can be lubricated only with grease, such as a ball bearing, can be used as the bearing portion. This technique can eliminate the use of a lubricating oil circulation fluidization mechanism for preventing the wear of the bearing portion and further can prevent the flow of a refrigerant/lubricant mixture so as to increase the purity of the refrigerant. As a result, the heat transfer performance of the heat exchangers can be dramatically improved and thus the efficiency of the air conditioner can be improved.

Furthermore, since the motor stator portions that have generated heat are cooled using the refrigerant liquid on the condenser 23 side, the single-phase refrigerant liquid can be circulated while being prevented from boiling in the cooling circuit passing through the stator portions. Therefore, the liquid flow pressure loss in this cooling circuit is reduced to maintain a high flow rate. Thereby, the cooling performance can be improved. In addition, the heat generated in the motor stator portions can be recovered for use as energy for heating.

<Modification>

Figure 2:
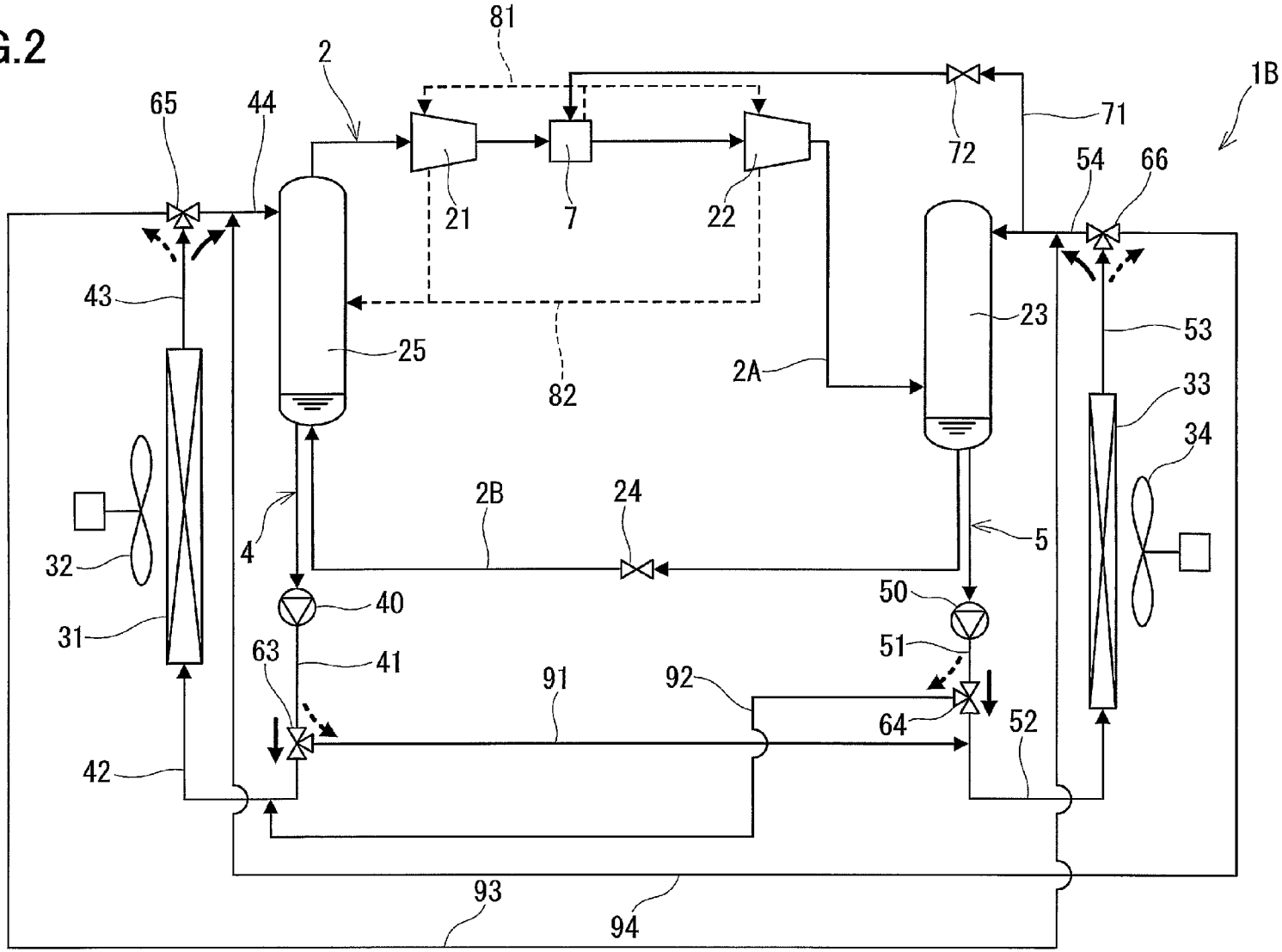
FIG. 2 is a configuration diagram of an air conditioner according to a modification.
Figure 3:
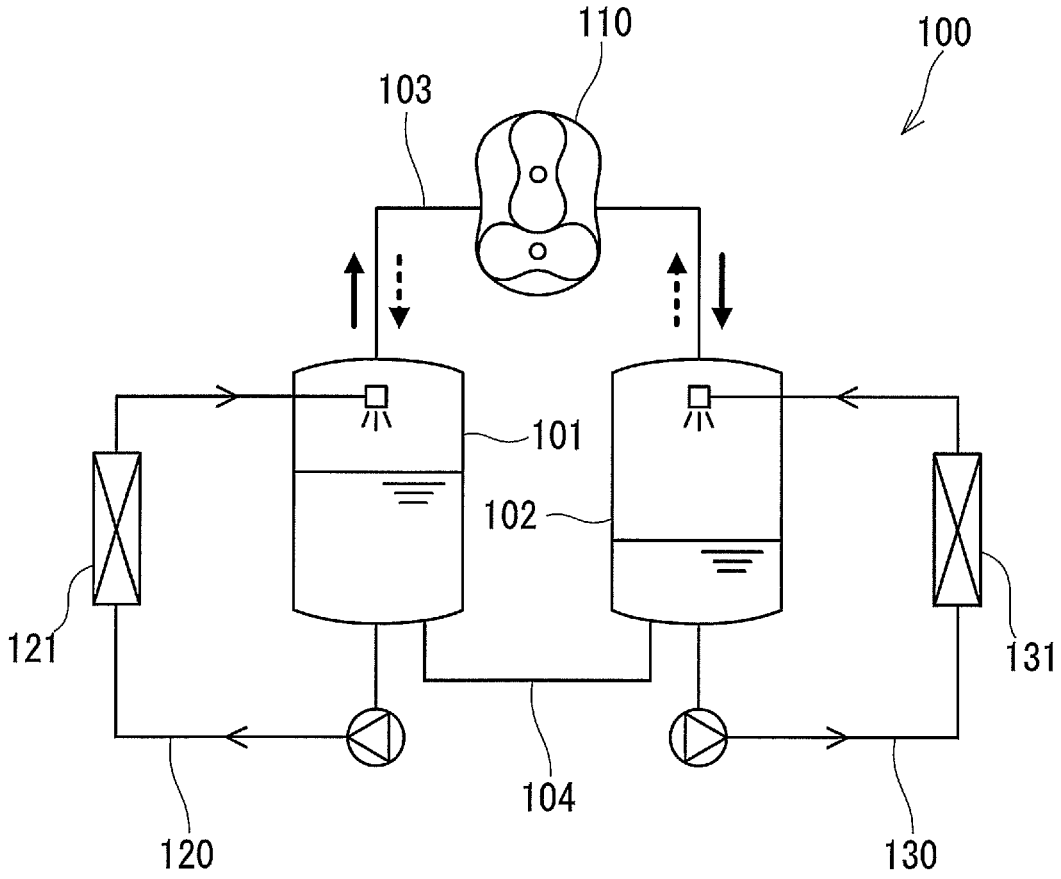
FIG. 3 is a configuration diagram of a conventional air conditioner.

In the previously-described embodiment, the first four-way valve 61 and the second four-way valve 62 are used as the first switching means and the second switching means of the present invention, but the first switching means and the second switching means of the present invention are not limited to these. For example, like an air conditioner 1B of a modification shown in FIG. 2, the first switching means and the second switching means may be configured using three-way valves.

Specifically, the first switching means may include: a first three-way valve 63 connected to the first flow path 41 and the second flow path 42 of the first circulation path 4; a second three-way valve 64 connected to the first flow path 51 and the second flow path 52 of the second circulation path 5; a first communication path 91 connecting the first three-way valve 63 and the second flow path 52; and a second communication path 92 connecting the second three-way valve 64 and the second flow path 42. The second switching means may include: a third three-way valve 65 connected to the third flow path 43 and the fourth flow path 44 of the first circulation path 4; a fourth three-way valve 66 connected to the third flow path 53 and the fourth flow path 54 of the second circulation path 5; a third communication path 93 connecting the third three-way valve 65 and the fourth flow path 54; and a fourth communication path 94 connecting the fourth three-way valve 66 and the fourth flow path 44.

The vapor channel 2A is not provided with the intercooler 7. Only one compressor may be provided on the vapor channel 2A. However, the temperature of the refrigerant vapor flowing into the condenser 23 can be lowered by the intercooler 7 if it is provided as in the previously-described embodiment.

INDUSTRIAL APPLICABILITY

The refrigeration apparatus of the present invention is useful for air conditioners, chillers, heat storage devices, etc., and is particularly useful for household air conditioners, industrial air conditioners, etc.

The invention claimed is:

1. A refrigeration apparatus comprising:

an evaporator that retains a refrigerant liquid and that evaporates the refrigerant liquid therein;

a condenser that condenses a refrigerant vapor therein and that retains the refrigerant liquid;

a vapor channel that directs the refrigerant vapor from the evaporator to the condenser and that is provided with a compressor;

a liquid channel that directs the refrigerant liquid from the condenser to the evaporator;

a first circulation path that allows the refrigerant liquid retained in the evaporator to circulate via a first heat exchanger and that is provided with a first pump at a position upstream from the first heat exchanger;

a second circulation path that allows the refrigerant liquid retained in the condenser to circulate via a second heat exchanger and that is provided with a second pump at a position upstream from the second heat exchanger;

a first four-way valve that is provided on the first circulation path and the second circulation path and that is switched between a first state and a second state, the first state being a state in which the refrigerant liquid pumped from the first pump is directed to the first heat exchanger and the refrigerant liquid pumped from the second pump is directed to the second heat exchanger, and the second state being a state in which the refrigerant liquid pumped from the first pump is directed to the second heat exchanger and the refrigerant liquid pumped from the second pump is directed to the first heat exchanger; and a second four-way valve that is provided on the first circulation path and the second circulation path and that is switched between a first state and a second state, the first state being a state in which the refrigerant liquid flowing from the first heat exchanger is directed to the evaporator and the refrigerant liquid flowing from the second heat exchanger is directed to the condenser, and the second state being a state in which the refrigerant liquid flowing from the first heat exchanger is directed to the condenser and the refrigerant liquid flowing from the second heat exchanger is directed to the evaporator, wherein the first circulation path includes: a first flow path connecting the evaporator and an inlet of the first four-way valve; a second flow path connecting an outlet of the first four-way valve and an inlet of the first heat exchanger; a third flow path connecting an outlet of the first heat exchanger and an inlet of the second four-way valve; and a fourth flow path connecting an outlet of the second four-way valve and the evaporator, the second circulation path includes: a first flow path connecting the condenser and another inlet of the first four-way valve; a second flow path connecting another outlet of the second four-way valve and an inlet of the second heat exchanger; a third flow path connecting an outlet of the second heat exchanger and another inlet of the second four-way valve; and a fourth flow path connecting another outlet of the second four-way valve and the condenser, when the first four-way valve is in the first state and the second four-way valve is in the first state, (i) the refrigerant liquid retained in the evaporator flows through the first flow path of the first circulation path, the first four-way valve, the second flow path of the first circulation path, the first heat exchanger, the third flow path of the first circulation path, the second four-way valve, and the fourth flow path of the first circulation path in this order, and (ii) the refrigerant liquid retained in the condenser flows through the first flow path of the second circulation path, the first four-way valve, the second flow path of the second circulation path, the second heat exchanger, the third flow path of the second circulation path, the second four-way valve, and the fourth flow path of the second circulation path in this order, and when the first four-way valve is in the second state and the second four-way valve is in the second state, (iii) the refrigerant liquid retained in the evaporator flows through the first flow path of the first circulation path, the first four-way valve, the second flow path of the second circulation path, the second heat exchanger, the third flow path of the second circulation path, the second four-way valve, and the fourth flow path of the first circulation path in this order, and (iv) the refrigerant liquid retained in the condenser flows through the first flow path of the second circulation path, the first four-way valve, the second flow path of the first circulation path, the first heat exchanger, the third flow path of the first circulation path, the second four-way valve, and the fourth flow path of the second circulation path in this order.

2. The refrigeration apparatus according to claim 1, wherein the compressor includes: a first compressor that compresses the refrigerant vapor that has flowed from the evaporator; and a second compressor that further compresses the refrigerant vapor that has been compressed by the first compressor, the vapor channel is provided with an intercooler that cools the refrigerant vapor between the first compressor and the second compressor, the refrigeration apparatus further comprises a vapor cooling channel that is branched from the second circulation path and is connected to the intercooler, and the intercooler is configured to cool the refrigerant vapor by mixing the refrigerant liquid supplied from the vapor cooling channel with the refrigerant vapor or by exchanging heat between the refrigerant vapor and the refrigerant liquid.

3. The refrigeration apparatus according to claim 2, wherein the vapor cooling channel is branched from the second circulation path at a position downstream from the second four-way valve, and the vapor cooling channel is provided with a flow rate regulating mechanism.

4. The refrigeration apparatus according to claim 2, further comprising:

a bearing cooling channel that withdraws the refrigerant vapor cooled by the intercooler from the intercooler or the vapor channel and that feeds the withdrawn refrigerant vapor to bearing portions of the first compressor and the second compressor; and a recovery channel that returns the refrigerant vapor from the bearing portions of the first compressor and the second compressor to the evaporator.

5. The refrigeration apparatus according to claim 1, wherein a height from a suction port of the first pump to a level of the refrigerant liquid retained in the evaporator is 200 mm or more, and a height from a suction port of the second pump to a level of the refrigerant liquid retained in the condenser is 200 mm or more.

* * * * *